US009803947B2

(12) United States Patent
Poling

(10) Patent No.: US 9,803,947 B2
(45) Date of Patent: Oct. 31, 2017

(54) BIPOD WITH DUAL AXIS ROTATING CAPABILITY

(71) Applicant: Dale Avery Poling, Potomac, MT (US)

(72) Inventor: Dale Avery Poling, Potomac, MT (US)

( * ) Notice: Subject to any disclaimer, the term of this patent is extended or adjusted under 35 U.S.C. 154(b) by 5 days.

(21) Appl. No.: 14/643,115

(22) Filed: Mar. 10, 2015

(65) Prior Publication Data

US 2016/0265864 A1 Sep. 15, 2016

Related U.S. Application Data

(63) Continuation-in-part of application No. 14/508,490, filed on Oct. 7, 2014, now Pat. No. 9,435,601, which is a continuation of application No. 13/784,773, filed on Mar. 4, 2013, now Pat. No. 8,863,430, which is a continuation-in-part of application No. 12/930,574, filed on Jan. 11, 2011, now Pat. No. 8,443,540.

(51) Int. Cl.
*F41A 23/10* (2006.01)

(52) U.S. Cl.
CPC ..... *F41A 23/10* (2013.01)

(58) Field of Classification Search
CPC ..... F41A 23/16; F41A 23/08; F41A 23/00; F41A 23/02; F41A 23/10; F41C 33/001
See application file for complete search history.

(56) References Cited

U.S. PATENT DOCUMENTS 1,339,410 A * 5/1920 Norman ..... F41A 23/08 269/287
1,382,409 A * 6/1921 Butler ..... F41A 23/08 248/166
1,524,973 A * 2/1925 Hazelton ..... F41A 23/08 248/168
1,580,406 A * 4/1926 Browning ..... F41A 23/08 42/94
2,420,267 A * 5/1947 Sefried ..... F41A 23/08 403/157
2,807,904 A * 10/1957 Kreske ..... F41A 23/08 42/94
3,235,997 A * 2/1966 Stoner ..... F41A 23/08 42/94
3,327,422 A * 6/1967 Harris ..... F41A 23/08 42/94
3,745,879 A * 7/1973 Asikainen ..... F41A 27/06 89/37.05
4,288,939 A * 9/1981 Beretta ..... F41A 23/08 42/94
4,351,224 A * 9/1982 Curtis ..... F41A 23/08 42/94

(Continued)

*Primary Examiner* — Michelle R Clement
*Assistant Examiner* — Bridget Cochran
(74) *Attorney, Agent, or Firm* — David O. Simmons

(57) ABSTRACT

A bipod that allows for panning (i.e., via pivoting) of a firearm mounted on the bipod without repositioning one or both of the bipod leg feet. To this end, the bipod is configured for allowing a firearm attached thereto to be independently rotated about and perpendicular to an axis extending parallel to a longitudinal axis of the barrel of the firearm. Advantageously, in many situations, this will allow the shooter to position the firearm in a preferred shooting position and to follow or acquiring a target with a sighting device of the firearm without having to reposition one or both of the bipod leg feet.

11 Claims, 5 Drawing Sheets

(56) References Cited

U.S. PATENT DOCUMENTS 4,903,425 A * 2/1990 Harris ..... F41A 23/08 42/94
5,074,188 A * 12/1991 Harris ..... F41A 23/08 42/94
5,194,678 A * 3/1993 Kramer ..... F16M 11/16 42/94
5,711,103 A * 1/1998 Keng ..... F41A 23/10 42/94
5,852,892 A * 12/1998 Bilgeri ..... F41A 23/08 42/72
6,289,622 B1 * 9/2001 Desch, Jr. ..... F41A 23/10 42/94
6,763,627 B1 * 7/2004 Kaempe ..... F41A 23/10 42/94
6,785,997 B2 * 9/2004 Oz ..... F41G 1/35 42/146
6,829,857 B1 * 12/2004 Houtsma ..... F41A 23/10 248/532
6,920,713 B1 * 7/2005 Love ..... F41A 23/04 42/90
7,401,431 B2 * 7/2008 Pierce ..... F41A 23/08 42/94
7,478,496 B2 * 1/2009 Bender ..... F41A 23/10 248/176.1
7,614,174 B1 * 11/2009 Beltz ..... F41A 23/10 42/72
8,291,633 B1 * 10/2012 Hass ..... F41A 23/10 42/72
8,402,684 B1 * 3/2013 Beltz ..... F41A 23/10 42/72
8,413,569 B1 * 4/2013 Helton ..... F41A 23/58 89/37.01
8,418,394 B2 * 4/2013 Keng ..... F41A 23/10 248/163.2
8,863,430 B2 * 10/2014 Poling ..... F41A 23/10 248/163.1
8,904,693 B1 12/2014 Beltz
2005/0188596 A1 * 9/2005 Wygant ..... F41A 23/08 42/94
2005/0242250 A1 * 11/2005 Keng ..... F16M 11/10 248/168
2010/0218411 A1 * 9/2010 Keng ..... F41A 23/10 42/94
2012/0174459 A1 * 7/2012 Poling ..... F41A 23/08 42/94
2013/0000477 A1 * 1/2013 Larue ..... F41A 23/02 89/37.04

* cited by examiner

BIPOD WITH DUAL AXIS ROTATING CAPABILITY

CROSS REFERENCE TO RELATED APPLICATIONS

This continuation-in-part patent application claims priority to co-pending United States (U.S.) Non-provisional patent application Ser. No. 14/508,490, filed Oct. 7, 2014, and entitled "BIPOD LEG MOUNTING BODY AND BIPOD COMPRISING SAME". U.S. Non-provisional patent application having Ser. No. 14/508,490 claims priority as a continuation patent application to United States Non-Provisional patent application having Ser. No. 13/784,773 that was filed Mar. 4, 2013, and entitled "BIPOD LEG MOUNTING BODY AND BIPOD COMPRISING SAME", now issued as U.S. Pat. No. 8,863,430. United States Non-Provisional patent application having Ser. No. 13/784,773 claim priority as continuation-in-part patent application to U.S. Non-Provisional patent application having Ser. No. 12/930,574, filed Jan. 11, 2011, and entitled "BIPOD LEG MOUNTING BODY AND BIPOD COMPRISING SAME", now issued as U.S. Pat. No. 8,443,540. All of these applications have a common applicant and inventor therewith and are being incorporated herein in their entirety by reference.

FIELD OF THE DISCLOSURE

The disclosures made herein relate generally to firearm accessories and, more particularly, to a bipod configured for allowing a firearm attached thereto to be independently rotated about a longitudinal axis and rotated about an axis extending perpendicular to the longitudinal axis while legs of the bipod remain in a fixed position with respect to a support structure with which they are engaged.

BACKGROUND

A bipod is an essential asset to many shooters. It provides them with a solid platform for making accurate shots from a prone shooting position. To this end, in most cases, a shooter will configure his or her bipod for their particular prone shooting position. This will typically include setting legs of the bipod to a length corresponding to their prone shooting position.

A drawback of conventional bipods is that they do not readily accommodate panning (i.e., rotating by pivoting about an axis extending vertically perpendicular to the longitudinal axis of the barrel) of a firearm (i.e., a weapon) mounted on the bipod without repositioning one or both of the bipod leg feet (i.e., feet at the terminal end of each leg of the bipod). For example, with the bipod leg feet engaged with a support structure, a shooter will often have the need to pan the firearm about an axis extending vertically perpendicular to the longitudinal axis of the barrel. With conventional bipods, the shooter will need to disengage at least one bipod leg foot for allowing the bipod and, thus the firearm, to be rotated side-to-side, this is generally undesirable as it can be a cumbersome and low-resolution approach to pan the firearm such as for following or acquiring a target.

Another drawback of conventional bipods is that they do not readily accommodate uneven surfaces upon which the legs of the bipod might come to rest when a shooter sets up in their prone shooting position. For example, with the bipod legs having been pre-set by the shooter for a level shooting surface, the shooter will find that their firearm is not in a preferred shooting position when one leg of the bipod comes to rest on an obstruction such as a rock or within a depression. In many situations (e.g., a hostile environment), it is not practical or possible for the shooter to re-position the bipod or reconfigure the bipod (e.g., adjust leg length) so as to achieve a bipod orientation that puts their firearm in a preferred shooting position. Moreover, doing so requires the shooter to break from eye focus on a target through an optical scope and then reacquire sight on the target after repositioning the bipod legs.

Therefore, a bipod configured in a manner that overcomes drawbacks associated with conventional bipods would be advantageous, desirable and useful.

SUMMARY OF THE DISCLOSURE

Embodiments of the present invention relate to a bipod configured in a manner that overcomes drawbacks associated with conventional bipods. Unlike conventional bipods, a bipod configured in accordance with an embodiment of the present invention allows for panning (i.e., side-to-side pivoting) of a firearm mounted on the bipod without repositioning one or both of the bipod leg feet and readily accommodates uneven surfaces upon which the legs of the bipod leg feet might come to rest when a shooter sets up in their prone shooting position. For example, with the bipod legs having been pre-set by the shooter for a level shooting surface, a bipod configured in accordance with the present invention allows for the firearm to be independently rotated about and perpendicular to an axis extending parallel to a longitudinal axis of the barrel of the firearm. In this manner, when needed (e.g., when one of the bipod leg feet comes to rest on an obstruction such as a rock or within a depression), the shooter will be able to rotate the firearm about and perpendicular to the axis extending parallel to the longitudinal axis of the barrel of the firearm. Advantageously, in many situations, this will allow the shooter to position the firearm in a preferred shooting position and to follow or acquire a target with a sighting device of the firearm without having to reposition one or both of the bipod leg feet.

In one embodiment of the present invention, a bipod comprises a leg mounting body and a articulation enabling assembly. The leg mounting body includes leg mounting structures and an interposer body mounting structure therebetween. The articulation enabling assembly includes a first articulating body and a second articulating body. The second articulating body is rotatably attached to the first articulating body. The first articulating body is rotatably attached to the articulating body mounting structure of the leg mounting body. An axis of rotation of the second articulating body extends perpendicular to an axis of rotation of the first articulating body.

In another embodiment of the present invention, a bipod comprises a leg mounting body, an interposer body, and a firearm mounting body. The leg mounting body includes an interposer body mounting structure and two leg mounting structures. Each one of the leg mounting structures extend from a respective one of opposing sides of the interposer body mounting structure. The interposer body is attached to the leg mounting body. The interposer body is rotatable with respect to the leg mounting body about a first axis of rotation. The firearm mounting body is attached to the interposer body. The firearm mounting body is rotatable with respect to the interposer body about a second axis of rotation that extends perpendicular to the first axis of rotation.

In another embodiment of the present invention, a bipod comprises a leg mounting body, an interposer body, and a firearm mounting body. The leg mounting body includes an interposer body mounting structure and two leg mounting structures. Each one of the leg mounting structures extend from a respective one of opposing sides of the interposer body mounting structure. The interposer body includes a central passage having a longitudinal axis. A protruding member of the interposer body is engaged within a mating recess of the interposer body mounting structure. The protruding member and the mating recess jointly define mating bearing surfaces thereof for constraining relative rotational movement between the interposer body and the leg mounting body to being about a first axis of rotation. The firearm mounting body has a cylindrical portion thereof rotatable engaged with the interposer body within the central passage thereof such that the firearm mounting body is rotatable with respect to the interposer body about a second axis of rotation defining by the longitudinal axis of the central passage of the interposer body. The second axis of rotation extends perpendicular of the first axis of rotation. The cylindrical portion of the firearm mounting body and the central passage of the firearm mounting body jointly define mating bearing surfaces thereof for constraining relative rotational movement between the firearm mounting body and the interposer body to being about the second axis of rotation. The firearm mounting body includes a firearm attachment structure protruding therefrom.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
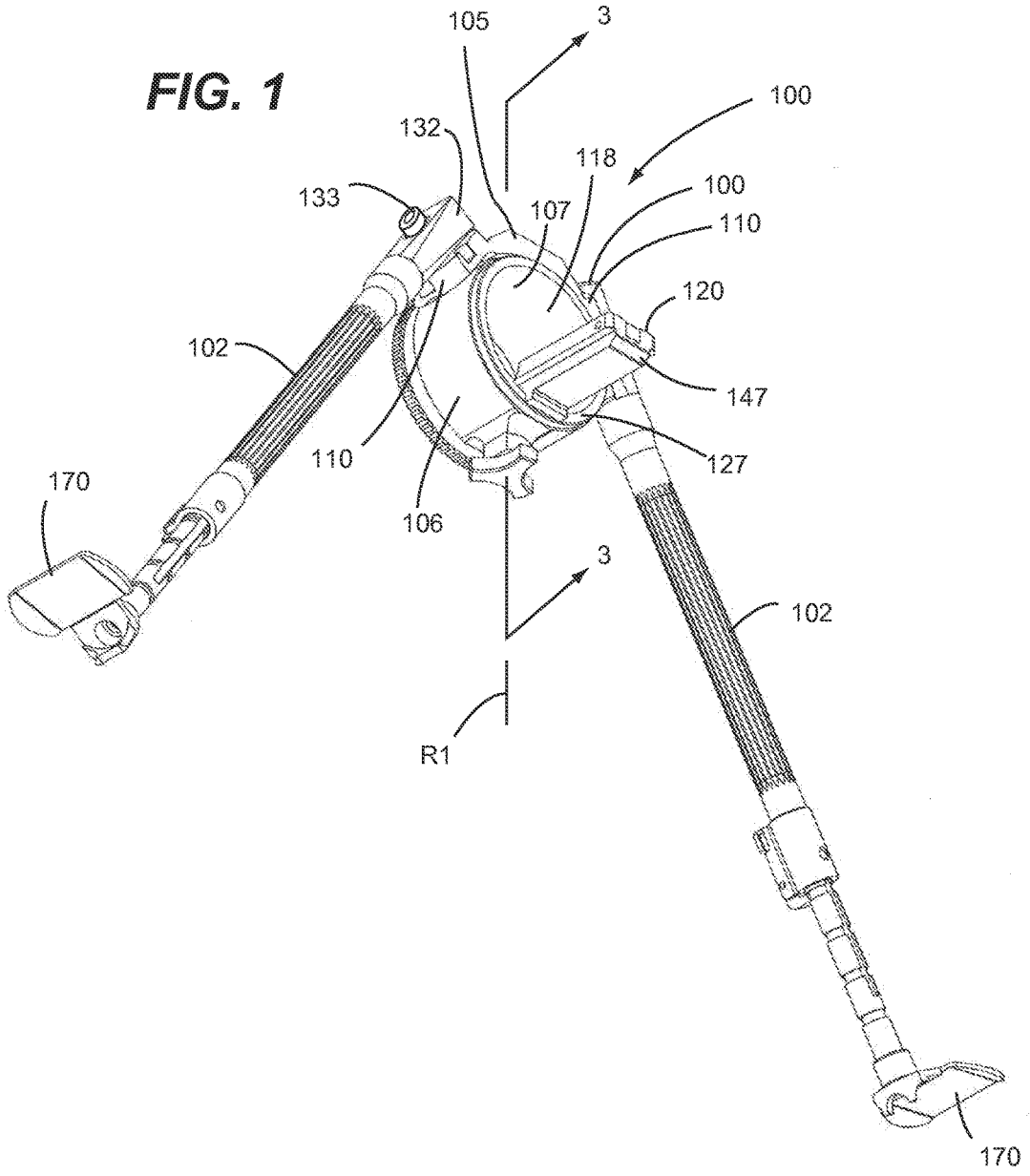
FIG. 1 is a perspective view of a bipod configured in accordance with the present invention.
Figure 2:
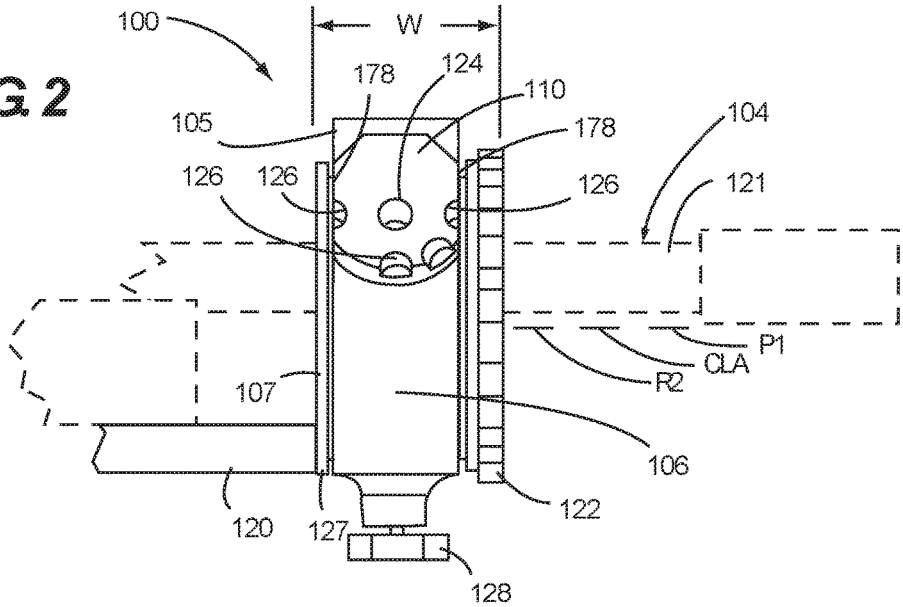
FIG. 2 is a side view of the bipod of FIG. 1, with legs thereof omitted.
Figure 3:
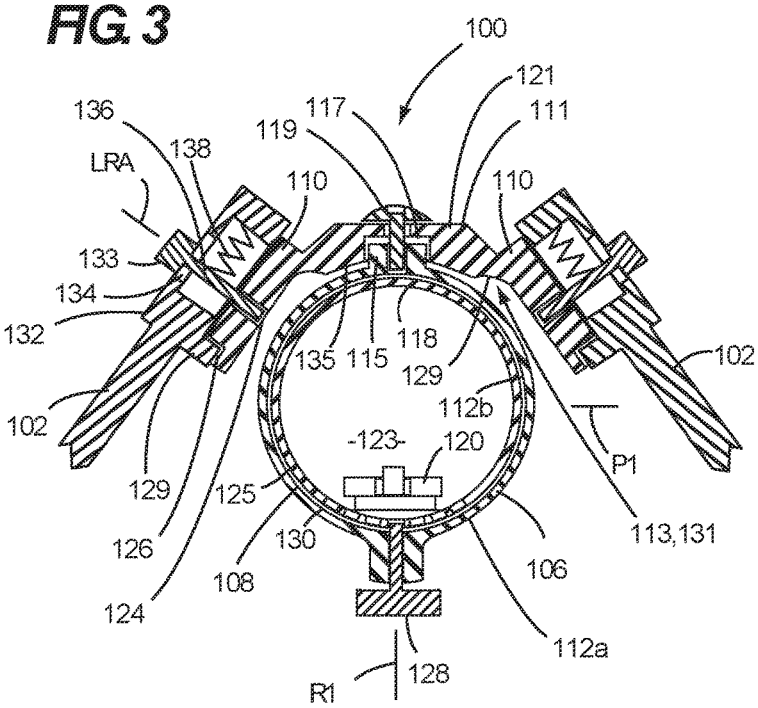
FIG. 3 is a cross-sectional view taken along the line 3-3 in FIG. 1.
Figure 4:
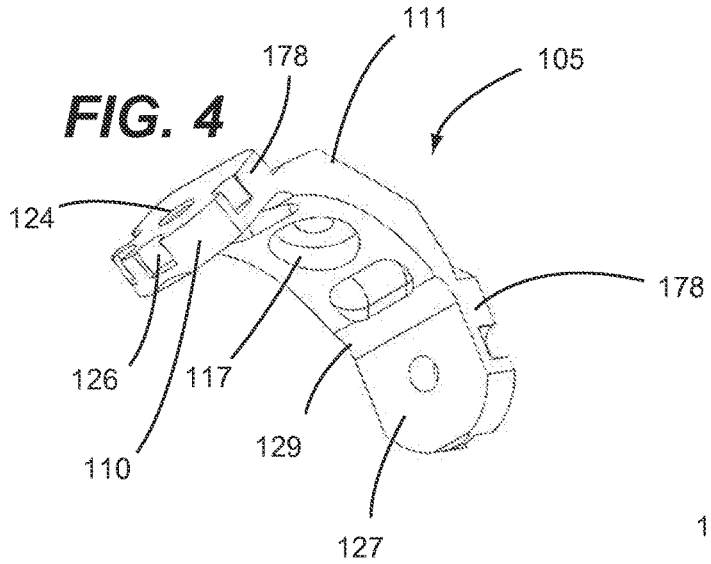
FIG. 4 is a perspective view of a leg mounting body of the bipod of FIG. 1.
Figure 5:
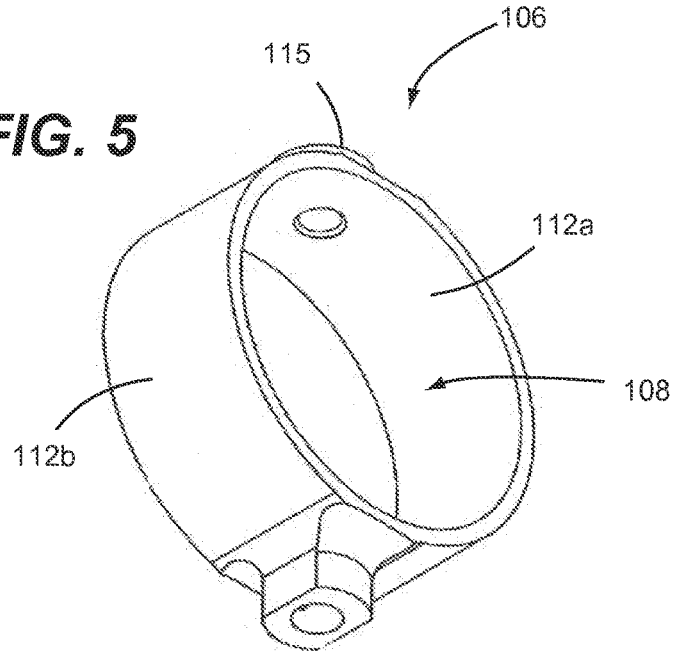
FIG. 5 is a perspective view of an interposer body of the bipod of FIG. 1.

FIGS. 1-3 show a bipod 100 configured in accordance with an embodiment of the present invention. In FIG. 2, a firearm 104 attached to the bipod 100 and legs 102 of the bipod 100 are omitted for clarity. The bipod 100 is configured for accommodating uneven surfaces upon which legs 102 of the bipod 100 might come to rest when a shooter sets up in their prone shooting position to shoot a firearm 104 attached to the bipod 100. For example, with the legs 102 having been pre-set (e.g., to a prescribed length) by the shooter for a level shooting surface, the bipod 100 allows for a firearm 104 attached to the bipod 100 to be rotated about an axis extending parallel to a longitudinal axis of the barrel of the firearm 104. In this manner, when one or both of the legs 102 come to rest on an obstruction or within a depression such that the firearm 104 is not in the shooter's preferred shotting position, the bipod 100 allows the shooter to rotate the firearm 104 axially to a position in which the firearm 104 in a preferred shooting position. Additionally, the bipod 100 allows for panning (i.e., pivoting) of the firearm 104 without repositioning one or both of the legs 102 (e.g., reposition bipod leg feet thereof upon a support structure/surface). As such, with a bipod configured in accordance with the present invention, it is readily possible for the shooter to quickly and simply rotationally reposition a firearm with respect to the legs 102 of the bipod 100 so as to put the firearm 104 in the preferred shooting position and to follow or acquiring a target with a sighting device of the firearm 104 without having to reposition one or both of the legs 102.

The bipod 100 includes a leg mounting body 105, an interposer body 106 (i.e., a first articulating body), and a firearm mounting body 107 (i.e., a second articulating body). As discussed below in greater detail, the leg mounting body 105, the interposer body 106, and the firearm mounting body 107 are jointly configured for enabling the firearm 104, which is attached to the firearm mounting body 107, to be independently rotated about two axes extending perpendicularly to each other.

The leg mounting body 105, shown in FIGS. 1-4, includes two leg mounting structures 110 and an interposer body mounting structure 111. The leg mounting structures 110 are spaced apart from each other and extend downwardly from the interposer body mounting structure 111. In this manner, the leg mounting structures 110 and the interposer body mounting structure 111 jointly define an interposer body receiving space 113 of the leg mounting body 105. Preferably, but not necessarily, the mounting structures 110 extend downwardly and away from each other such that the interposer body receiving space 113 is generally in the shape of an inverted "V".

As best shown in FIGS. 1-3 and 5, the interposer body 106 has a generally cylindrical shape with a central passage 108. The central passage 108 is preferably substantially round and defines an interior surface 112*a* of the interposer body 106. A protruding member 115 extends from an exterior surface 112*b* of the interposer body 106 and is engaged within a mating recess 117 of the interposer body mounting structure 111. A retention member 119 such as, for example, a threaded fastener (e.g., a screw) is engaged between the interposer body mounting structure 111 and the protruding member 115 for securing the interposer body 106 to the leg mounting body 105. The protruding member 115 and the mating recess 117 jointly define mating bearing surfaces for constraining relative rotational movement between the interposer body 106 and the leg mounting body 105 to being about a first axis of rotation R1. Preferably, but not necessarily, the protruding member 115 includes a post with a round cross-sectional shape and the mating recess 117 has a round cross-sectional shape. Preferably, but not necessarily, an interfacing member such as, for example, a Belleville washer (not shown) can be located within the recess 117 of the interposer body mounting structure 111 between the protruding member 115 and the interposer body mounting structure 111.

Referring to FIGS. 1-3, the firearm mounting body 107 has a cylindrical portion 118 and a firearm attachment structure 120 attached to the cylindrical portion 118. The cylindrical portion 118 is rotatably mounted within the central passage 108 of the interposer body 106 such that a rotational axis R2 of the cylindrical portion 118 with respect to the interposer body 106 extends along a centerline longitudinal axis CLA of the central passage 108 of the interposer body 106. The firearm mounting body 107 is configured such that at least a barrel 121 (FIG. 1) of the firearm 104 extends through a central passage 123 of the cylindrical portion 118 when the firearm attachment structure 120 is attached to the firearm 104. As shown, the interior surface 112*a* of the interposer body 106 and a mating exterior surface 125 of the cylindrical portion 118 are both substantially smooth. Alternatively, the interior side surface 112*a* of the interposer body 106 or the exterior surface 125 of the cylindrical portion 118 can have a plurality of annular ribs and grooves (not shown) so as to reduce the potential for entry of contaminants within the sliding interface between the interposer body 106 and the cylindrical portion 118. It is also contemplated herein that a bearing or bushing can be provided between the interposer body 106 and the cylindrical portion 118 for affecting rotation therebetween.

The cylindrical portion 118 is retained within the central passage 108 by any suitable means for retention that allows rotation of the cylindrical portion 118 with respect to the interposer body 106. As shown in FIGS. 1-3, the means for retention can include a shoulder 127 on a first end of the cylindrical portion 118 and a threaded lock ring 122 engaged within mating threads at the second end of the cylindrical portion 118 thereby capturing the interposer body 106 between the shoulder 127 and the threaded lock ring 122. In such captured configuration, a first end face of the interposer body 106 abuts an inside face of the shoulder 127 and a second end face of the interposer body 106 abuts an inside face of the threaded lock ring 122.

As assembled, the interposer body 106 and the firearm mounting body 107 jointly define an articulation enabling assembly (i.e., articulation of the interposer body 106 about a first axis or rotation and articulation of the firearm mounting body 107 about a second axis of rotation). For the depicted embodiment, an overall width of the articulation enabling assembly (i.e., dimension W shown in FIG. 1) is defined by a longitudinal distance between an outside end face of the shoulder 127 of the firearm mounting body 107 and an outside end face of the threaded lock ring 122. In an alternate embodiment, the threaded lock ring 122 can be replaced by a c-clip or other form of clip for use on a cylindrical structure (not shown) and the mating threads can be replaced by a groove that receives the c-clip. In another embodiment, the means for retention can include a threaded fastener fixedly engaged with the interposer body 106 and extending into a slot within the cylindrical portion 118. In these alternate embodiments, the interposer body 106, the firearm mounting body 107 and the clip or fastener used for their coupling would be comprised by the articulation enabling assembly and an overall width of the articulation enabling assembly would be defined by a longitudinal distance between an outside end face of the shoulder 127 of the interposer body 106 and an opposing end face of the interposer body 106.

Figure 6:
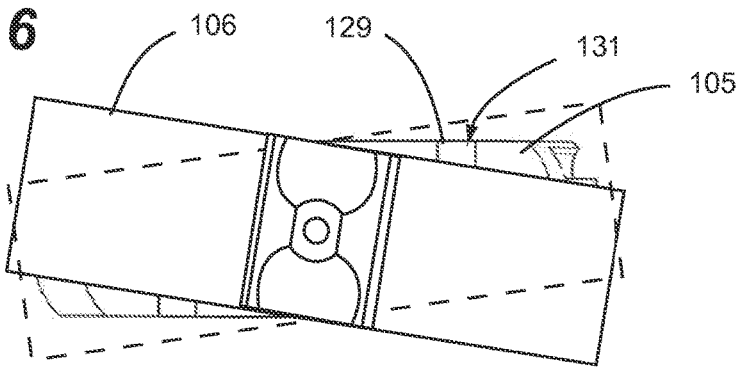
FIG. 6 is a bottom as-assembled view of the interposer body and a firearm mounting body of the bipod of FIG. 1.

Referring to FIGS. 3 and 6, a lower surface 135 of the interposer body mounting structure 111 that defines a respective portion of the interposer body receiving space 113 has a contour substantially conforming with an adjacent portion of an exterior surface the interposer body 106 (e.g., concentrically aligned curved faces). A lower surface 124 of each one of the leg mounting structures 110 is outwardly offset from the lower surface 135 of the interposer body mounting structure 111 such that a transitional surface 129 between the lower surface 135 of the interposer body mounting structure 111 and the lower surface 124 of each one of the leg mounting structures defines a respective clearance space 131 into which the interposer body 106 can encroach during relative rotational movement between the leg mounting body 105 and the interposer body 106.

As best shown in FIGS. 2 and 3, each one of the leg mounting structures 110 includes a leg retention feature 124 (e.g., a threaded hole) configured for allowing the legs 102 to be attached to the leg mounting body 105. Each leg retention feature 124 is within a front face of the respective one of the leg mounting structures 110 and defines a respective leg rotational axis LRA. Each one of the legs 102 are pivotable about a leg retaining member 133 (e.g., a threaded fasteners such as a screw or shoulder bolt) secured in the leg retention feature 124 of the respective one of the leg mounting structures 110.

Preferably, the leg retention feature 124 of each one of the leg mounting structures 110 lies on the same side of a horizontal plane P1 extending through the axis of rotation R2 of the cylindrical portion 118. Preferably, the leg mounting structures 110 are an equal distance above the plane P1. Preferably, the leg retention feature 124 of each one of the leg mounting structures 110 is above the plane P1 when ground engaging ends of the legs 102 (i.e., the feet 170) are engaged with the ground, floor or other similar support surface. Preferably, as shown in FIG. 2, the respective leg rotational axis LRA of each one of the leg mounting structures 110 extends generally perpendicular to the rotational axis R2 of the cylindrical portion 118. The leg mounting structures 110 can extend downwardly and away from each other such that the leg rotational axis LRA of the leg mounting structures 110 intersect each other above, at or below the rotational axis R2 of the cylindrical portion 118. It is disclosed herein that the leg retention feature 124 of each one of the leg mounting structures 110 can be diametrically opposed to each other. Of course, because the firearm mounting body 107 can rotate a full 360 degrees relative to the interposer body 106, the bipod 100 can be used with the legs 102 extending upward or at any other angle necessary to provide secure support Still referring to FIGS. 1 and 2, each one of the leg mounting structures 110 also includes a plurality of recesses 126 (i.e., leg positioning features 126). The recesses 126 are selectively engagable by a protrusion 129 (i.e., a mating feature) of a respective one of the legs 102 during rotation of the respective one of the legs 102. For example, the recesses 126 can be positioned for allowing each one of the legs 102 to be secured in any one of a plurality of use (i.e., deployed) positions such as the use position shown in FIGS. 1 and 3 and to be secured in a stowed position (e.g., rotated 90 degrees aft of the first use position such that the legs extend substantially parallel with the centerline longitudinal axis of the barrel of the firearm).

As best shown in FIG. 3, the protrusion 129 can be a lug that is integral (e.g., unitarily formed with) a head portion 132 (i.e., first end portion) of the respective one of the legs 102. The head portion 132 has a slot-shaped passage 134 through which a shank portion 136 of the leg retaining member 138 extends. A spring 138 (i.e., a resilient member) biases the respective one of the legs 102 such that the protrusion 129 is engaged within one of the recesses 126 with which the protrusion 129 is aligned. As such, the orientation of the leg is defined by the position of the recess 126 with which the protrusion 129 is aligned and engaged within. Through manual application of force on a particular one of the legs 102 against the biasing force of the spring 138, the protrusion 129 becomes disengaged from within the recess 126 with which the protrusion 129 is engaged thereby allowing that particular one of the legs 102 to be pivoted to a different position. For example, each one of the legs 102 can be selectively moved between a plurality of different angular positions as defined by the angular orientation of the recesses 126 with respect to the leg retention feature 124 of the respective one of the leg mounting structures 110 (e.g., 0-degrees from vertical, +45/−45 degree from vertical, +90/−90 degree from vertical, etc). The protrusion 129 and the recesses 126 are one example of a leg positioning mechanism that is provided between a leg 102 and a respective one of the leg mounting structures 110. In another embodiment, the slot-shaped passage 134 within each one of the legs 102 may be replaced with a round passage and the protrusion 129 of each one of the legs 102 is replaced by a spring-biased ball such that selectively engages an aligned one of the recesses 126 for securing each leg 102 in a position corresponding to the engaged one of the recesses 126.

As disclosed above, the leg retention feature 124 of each one of the leg mounting structures 110 is preferably above the plane P1 when ground engaging ends of the legs 102 are engaged with the ground, floor or other similar support surface. To this end, the recess 126 corresponding to the 90-degree leg position (i.e., position corresponding to the respective leg 102 extending perpendicular to the axis of rotation R2 of the firearm mounting body 107, shown in FIGS. 1 and 3) is positioned on a respective one of the leg mounting structures 110 such that the leg retention feature 124 of each one of the leg mounting structures 110 is above the plane P1 when ground engaging ends of the legs 102 are engaged with the ground, floor or other similar support surface. Typical other ones of the recesses 126 are no farther than about 90 degrees away from this leg position. Furthermore, each one of the leg mounting structures 110 and the respective one of the legs 102 can be configured to inhibit the respective one of the legs 102 from being pivoted more than about 90 degrees away from the 90-degree leg position. For example, side surfaces 178 of each one of the leg mounting structures 110 (shown in FIG. 2) can be configured (e.g., of a suitable length) such that the protrusion 129 engages the corresponding one of the side surfaces 178 when the leg 102 is sufficiently pivoted more than 90 degrees away from the 90-degree leg position (e.g., 95 or 100 degrees away from the 90-degree leg position in either rotational direction). In this regard, the leg 102 can have a structural element that engages a mating structural element of the leg mounting structure 110 for inhibiting the respective one of the legs 102 from being pivoted more than about 90 degrees away from the 90-degree leg position. This can also be visualized as a position more than about 90-degrees away from a position in which a leg is substantially perpendicular to the centerline longitudinal axis CLA of the central passage 108 (e.g., as defined by a straight line extending between the respective leg rotational axis LRA and a portion of the leg that is intended to contact the ground when the bipod 100 is in upright use).

The interposer body 106 and the firearm mounting body 107 can be jointly configured for allowing the firearm mounting body 107 to be secured in a prescribed rotational position with respect to the interposer body 105. For example, as shown in FIG. 3, a locking member 128 engaged with the interposer body 106 can extend into one of a plurality of spaced part apertures 130 in the cylindrical portion 118. In this manner, an angular orientation of the firearm mounting body 107 with respect to the interposer body 106 can be selectively fixed.

Figure 7:
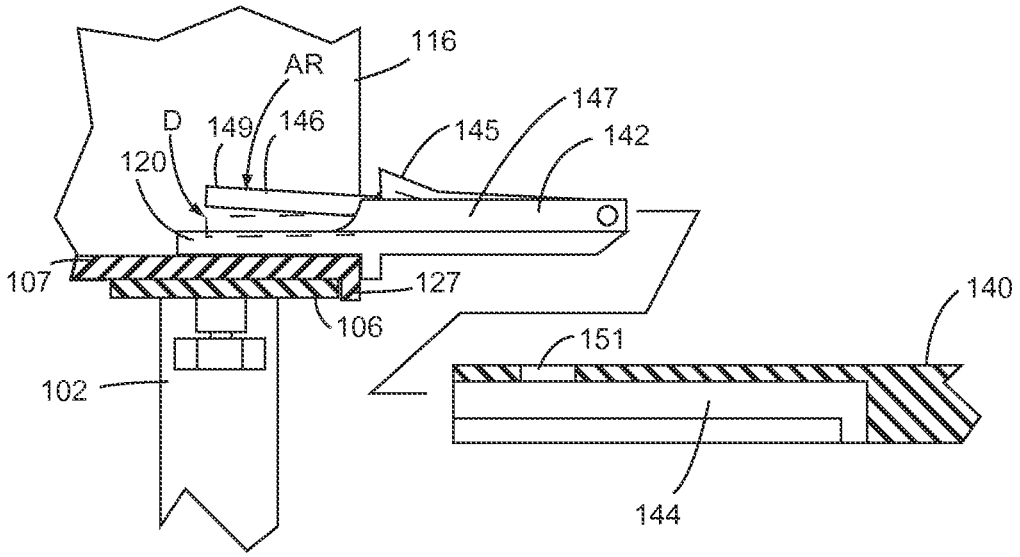
FIG. 7 is a fragmentary cross-sectional view showing a firearm attachment portion of the bipod of FIG. 1 in relation to a firearm mount, which is taken along a centerline of the firearm mount and along a face of the firearm attachment portion.

Referring to FIGS. 1, 2 and 7, the firearm attachment structure 120 of the firearm mounting body 107 is configured to be engaged with a firearm mount 140 thereby attaching the bipod 100 to the firearm 104. It is disclosed herein that the firearm attachment structure 120 can be suitably configured to be attached to a structural component of a firearm (e.g., the firearm 104) such as, for example, the barrel, a receiver, an accessory mounting rail or the like. In this manner, the bipod 100 can be fixedly attached to the firearm. The firearm mount 140 can be a discrete structure attachable to a firearm or a structure that is an integral (e.g., unitary formed) portion of a structure of the firearm. In the depicted embodiment, the firearm attachment structure 120 includes a nose portion 142. The nose portion 142 includes a main body 147 configured for being engaged within a channel 144 of the firearm mount 140 and a retention member 146 configured for being engaged with a mating portion of the firearm mount firearm 140 for inhibiting unintentional disengagement of the firearm mount 140 from the firearm attachment structure 120. The channel 144 is exposed at a first end portion of the firearm mount 140 and a firearm engagement portion can be at a second end portion of the firearm mount 140 or other region of the firearm mount 140. The nose portion 142 and the channel 144 can both have a T-shaped cross-sectional profile that enables the nose portion 142 to translate along a length of the channel 144 while translation and rotation in other directions is substantially constrained (i.e., functionally insignificant translation and rotation in such other directions). Upon a sufficient amount of insertion of the nose portion 142 into the channel 144, an engagement portion 145 (e.g., a protrusion) of a retention member 146 (e.g., a lever) of the firearm attachment structure 120 engages a mating retention structure 151 (e.g., hole or recess) of the firearm mount 140. The retention member 146 of the firearm attachment structure 120 is biased to an at-rest position AR (shown in FIG. 7) and is manually moveable to a displaced position D such as by depressing a control portion 149 of the retention member 146. In this manner, the retention member 146 of the firearm attachment structure 120 can be moved toward the displaced position for causing the engagement portion 145 of the retention member 146 to become disengaged from the mating retention structure 151 of the firearm mount 140 thereby allowing the nose portion 142 to be retracted from within the channel 144.

Figure 8:
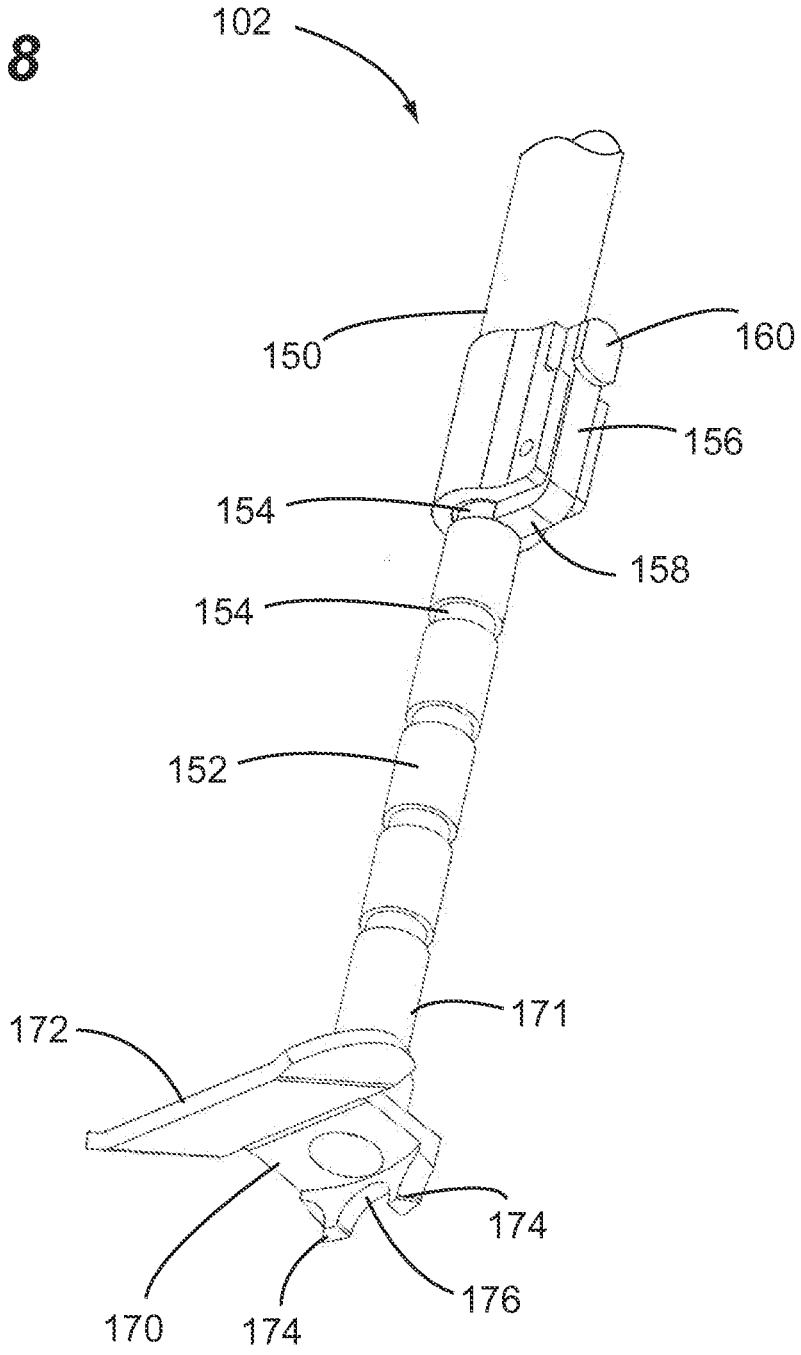
FIG. 8 is a fragmentary view showing a leg of the bipod of FIG. 1 in a partially extended configuration.

Referring now to FIG. 8, length adjustability of the legs 102 is discussed in greater detail. Each leg 102 includes an upper leg structure 150 and a lower leg structure 152. The upper leg structure 150 is the portion of each leg 102 that is pivotably attached to the leg mounting body 105. The lower leg structure 152 is mounted on the upper leg structure 150 in a manner allowing the lower leg structure 152 to be longitudinally extended and retracted with respect to the upper leg structure 150. As depicted, the lower leg structure 152 is slideably disposed within a central passage of the upper leg structure 150. The lower leg structure 152 includes a plurality of spaced apart annular grooves 154 (i.e., positioning structures) that can be individually and selectively engaged by a length adjustment device 156 (i.e., a lever) of the upper leg structure 150. Indicial such as numbers, letters or other configuration of symbols can be provided on (e.g., embossed within, printed on, etc) the lower leg structure 152 between the adjacent ones of the grooves for aiding in setting a desired length of the respective one of the legs 102. For example, the indicia can be used for setting a desired length of one of the legs 102 with respect to the other one of the legs 102. The length adjustment device 156 has a groove engaging portion 158 and a release portion 160. The length adjustment device 156 is pivotably attached to the upper leg structure 150 and is spring biased such that the groove engaging portion 158 is urged against the lower leg structure 152. In this manner, the groove engaging portion 158 of the length adjustment device 156 can be secured in one of the grooves 154 for securing the lower leg structure 152 in a fixed longitudinal position with respect to the upper leg structure 150. By depressing the release portion 160 of the length adjustment device 156, the groove engaging portion 158 becomes disengaged from the engaged one of the grooves 154 for allowing the lower leg structure 152 to be moved to a different longitudinal position (i.e., longitudinally adjusted) with respect to the upper leg structure 150.

Each one of the legs 102 includes a foot structure 170 (i.e., a bipod leg foot) at a distal end 171 of the leg 102 (i.e., the end of the leg opposite the upper leg structure 150). The foot structure 170 is preferably configured for providing support functionality on a variety of different surfaces. A large area support pad 172, which can extend substantially laterally with respect to the distal end 171 of the leg 102, provides for support on compactable surfaces such as sand, dirt and the like and can be used to engage an overhead support structure (e.g., a rafter) when the bipod 100 is used in an inverted orientation (i.e., legs 102 extending in an upward direction with respect to the leg mounting body 105). Prongs 174, which can extends substantially longitudinally with respect to the leg 102, provide for engagement in substantially solid support surfaces (e.g., via piercing engagement) such as for example, wood, stone, concrete, metal, compacted earth or the like. A geometrically shaped recess 176 (e.g., an arcuate such as a semi-circle, V-shaped groove, etc), which can be located between the prongs 174 and which can extends substantially longitudinally with respect to the leg 102, provide for engagement with a contoured surface and/or edge.

In one embodiment of the present invention, the bipod is provided in the form of a kit. The kit includes the bipod 100 and the firearm mount 140. Preferably, the firearm mount 140 is mountable on a firearm at an OEM (original equipment manufacturer) mounting structure (e.g., a barrel, receiver, accessory mounting rail, handguard, etc). Preferably, firearm mount 140 is configured such that the barrel 121 of the firearm 104 extends through the central passage 108 when the firearm mount 140 is mounted on the firearm 104 at the OEM mounting structure thereof. It is disclosed herein that the firearm mount 140 can be an integral element of a firearm (e.g., unitarily formed with a receiver, handguard or flash arrester thereof).

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A bipod, comprising: a leg mounting body including an interposer body mounting structure and two leg mounting structures, wherein each one of the leg mounting structures extend from a respective one of opposing sides of the interposer body mounting structure, wherein the interposer body mounting structure includes a recess having a longitudinal axis; an interposer body having a protruding member thereof rotatably engaged within the recess of the interposer body mounting structure for constraining relative rotational movement of the interposer body with respect to the leg mounting body to being about the longitudinal axis of the recess, wherein the interposer body includes a round central passage having a longitudinal axis; and a firearm mounting body having a cylindrical portion rotatably engaged within the round central passage of the interposer body for constraining relative rotational movement of the firearm mounting body with respect to the interposer body to being about the longitudinal axis of the round central passage of the interposer body.

2. The bipod of claim 1 wherein the protruding member and the recess jointly define mating bearing surfaces thereof for constraining relative rotational movement between the interposer body and the leg mounting body to being about the longitudinal axis of the recess.

3. The bipod of claim 1 wherein the interposer body includes a cylindrical portion; and the cylindrical portion of the interposer body defines the round central passage of the interposer body.

4. The bipod of claim 3 wherein: the leg mounting structures extend downwardly from the interposer body mounting structure such that the leg mounting structures and the interposer body mounting structure jointly define an interposer body receiving space of the leg mounting body; and the cylindrical portion of the interposer body is positioned within the interposer body receiving space of the leg mounting body.

5. The bipod of claim 4 wherein: a lower surface of the interposer body mounting structure that defines a respective portion of the interposer body receiving space having a contour substantially the same as an exterior surface of the cylindrical portion of the interposer body; and a lower surface of each one of the leg mounting structures is outwardly offset from the lower surface of the interposer body mounting structure such that a transition between the lower surface of the interposer body mounting structure and the lower surface of each one of the leg mounting structures defines a respective clearance space into which the interposer body can encroach during relative rotational movement between the leg mounting body and the interposer body.

6. The bipod of claim 1 wherein: a lower surface of the interposer body mounting structure and a lower surface of each one of the leg mounting structures jointly define an interposer body receiving space of the leg mounting body; a cylindrical portion of the interposer body is positioned within the interposer body receiving space of the leg mounting body; a lower surface of the interposer body mounting structure that defines a respective portion of the interposer body receiving space having a contour substantially the same as an exterior surface of the cylindrical portion of the interposer body; and the lower surface of each one of the leg mounting structures is outwardly offset from the lower surface of the interposer body mounting structure such that a transition between the lower surface of the interposer body mounting structure and the lower surface of each one of the leg mounting structures defines a respective clearance space into which the interposer body can encroach during relative rotational movement between the leg mounting body and the interposer body.

7. A bipod, comprising: a leg mounting body including an interposer body mounting structure and two leg mounting structures, wherein each one of the leg mounting structures extend from a respective one of opposing sides of the interposer body mounting structure, wherein the interposer body mounting structure includes a recess having a longitudinal axis; an interposer body including a round central passage having a longitudinal axis, wherein a protruding member of the interposer body is engaged within the recess of the interposer body mounting structure, wherein the protruding member and the recess jointly define mating bearing surfaces thereof for constraining relative rotational movement between the interposer body and the leg mounting body to being about the longitudinal axis of the recess; and a firearm mounting body having a cylindrical portion thereof rotatably engaged within the central passage of the interposer body, wherein the longitudinal axis of the central passage of the interposer body extends perpendicular to the longitudinal axis of the recess and wherein the cylindrical portion of the firearm mounting body and the central passage of the interposer body jointly define mating bearing surfaces thereof for constraining relative rotational movement between the firearm mounting body and the interposer body to being about the longitudinal axis of the central passage of the interposer body.

8. The bipod of claim 7 wherein: the interposer body includes a cylindrical portion defining the central passage of the interposer body; the leg mounting structures extends downwardly from the interposer body mounting structure such that the leg mounting structures and the interposer body mounting structure jointly define an interposer body receiving space of the leg mounting body; and the cylindrical portion of the interposer body is positioned within the interposer body receiving space of the leg mounting body.

9. The bipod of claim 8 wherein: a lower surface of the interposer body mounting structure that defines a respective portion of the interposer body receiving space having a contour substantially the same as an exterior surface of the cylindrical portion of the interposer body; and a lower surface of each one of the leg mounting structures is outwardly offset from the lower surface of the interposer body mounting structure such that a transition between the lower surface of the interposer body mounting structure and the lower surface of each one of the leg mounting structures defines a respective clearance space into which the interposer body can encroach during relative rotational movement between the leg mounting body and the interposer body.

10. The bipod of claim 7 wherein: a lower surface of the interposer body mounting structure and a lower surface of each one of the leg mounting structures jointly define an interposer body receiving space of the leg mounting body; a cylindrical portion of the interposer body is positioned within the interposer body receiving space of the leg mounting body; and the cylindrical portion of the interposer body defines the central passage thereof.

11. The bipod of claim 10 wherein: a lower surface of the interposer body mounting structure that defines a respective portion of the interposer body receiving space having a contour substantially the same as an exterior surface of the cylindrical portion of the interposer body; and the lower surface of each one of the leg mounting structures is outwardly offset from the lower surface of the interposer body mounting structure such that a transition between the lower surface of the interposer body mounting structure and the lower surface of each one of the leg mounting structures defines a respective clearance space into which the interposer body can encroach during relative rotational movement between the leg mounting body and the interposer body.

* * * * *